US010781383B2

(12) United States Patent
Alabbad et al.

(10) Patent No.: US 10,781,383 B2
(45) Date of Patent: Sep. 22, 2020

(54) PROCESS FOR THE UTILIZATION OF $C_5$ HYDROCARBONS WITH INTEGRATED PYGAS TREATMENT

(71) Applicant: SABIC Global Technologies B.V., Bergen op Zoom (NL)

(72) Inventors: Fares Alabbad, Jubail (SA); Mohamed Sabri Abdelghani, Riyadh (SA); Ernesto Uehara, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/074,930

(22) PCT Filed: Mar. 28, 2017

(86) PCT No.: PCT/IB2017/051766
§ 371 (c)(1),
(2) Date: Aug. 2, 2018

(87) PCT Pub. No.: WO2017/168320
PCT Pub. Date: Oct. 5, 2017

(65) Prior Publication Data

US 2019/0031967 A1 Jan. 31, 2019

Related U.S. Application Data

(60) Provisional application No. 62/316,045, filed on Mar. 31, 2016.

(51) Int. Cl.
*C10G 69/14* (2006.01)
*C10G 65/00* (2006.01)
(Continued)

(52) U.S. Cl.
CPC ..... *C10G 69/14* (2013.01); *C10G 65/00* (2013.01); *C10G 65/16* (2013.01); *C10G 69/00* (2013.01);
(Continued)

(58) Field of Classification Search
None
See application file for complete search history.

(56) References Cited

U.S. PATENT DOCUMENTS 5,925,799 A 7/1999 Stanley et al. ..... 585/259
6,090,270 A 7/2000 Gildert ..... 208/57
(Continued)

FOREIGN PATENT DOCUMENTS

CN 1193991 A 9/1998
CN 1047788 C 12/1999
(Continued)

OTHER PUBLICATIONS

International Search Report and Written Opinion for PCT/IB2017/051766 dated Jun. 26, 2017, 11 pages.

*Primary Examiner* — Tam M Nguyen
(74) *Attorney, Agent, or Firm* — Norton Rose Fulbright US LLP

(57) ABSTRACT

Methods and systems for treating pygas are disclosed. Methods include depentanizing the pygas to produce a $C_5$ stream and a $C_6$+ stream before hydrotreating the $C_6$+ stream, to integrate the processing of pygas with the production of isoprene, piperylene, and dicyclopentadiene. Systems include a depentanizer added before a pygas hydrotreatment unit.

7 Claims, 2 Drawing Sheets

(51) Int. Cl.
*C10G 65/16* (2006.01)
*C10G 69/00* (2006.01)

(52) U.S. Cl.
CPC ..... *C10G 2300/1044* (2013.01); *C10G 2300/4025* (2013.01); *C10G 2300/708* (2013.01); *C10G 2400/22* (2013.01); *C10G 2400/30* (2013.01)

(56) References Cited

U.S. PATENT DOCUMENTS

| | | | | |
|---|---|---|---|---|
| 8,663,458 | B2 | 3/2014 | Smith | |
| 2009/0183981 | A1 | 7/2009 | Podrebarac et al. ..... | 203/32 |
| 2012/0203039 | A1 | 8/2012 | Smith, Jr. ..... | 585/14 |
| 2014/0024867 | A1 | 1/2014 | Yachi et al. ..... | 585/256 |
| 2015/0119613 | A1 | 4/2015 | Schmidt et al. ..... | 585/251 |

FOREIGN PATENT DOCUMENTS

| | | | |
|---|---|---|---|
| CN | 101450884 | A | 6/2009 |
| CN | 104058914 | A | 9/2014 |
| JP | 2005213419 | A | 8/2005 |
| WO | WO2000043467 | | 7/2000 |
| WO | WO2001023332 | A1 | 4/2001 |

PROCESS FOR THE UTILIZATION OF $C_5$ HYDROCARBONS WITH INTEGRATED PYGAS TREATMENT

CROSS-REFERENCE TO RELATED APPLICATIONS

This application is a national phase application under 35 U.S.C. § 371 of International Application No. PCT/IB2017/051766 filed Mar. 28, 2017, which claims priority to U.S. Provisional Patent Application No. 62/316,045 filed Mar. 31, 2016. The entire contents of each of the above-referenced disclosures is specifically incorporated by reference herein without disclaimer.

FIELD

The disclosed subject matter relates to processes and systems for recovering $C_5$ hydrocarbons, integrated with pygas treatment.

BACKGROUND

Pygas, also known as pyrolysis gas, can be formed in the cracking furnaces of various refinery processes. Pygas can include alkanes, alkenes, alkynes, aromatics, naphthenes, alkyl aromatics and/or polyaromatics. After being formed in the cracking furnaces, pygas can be distilled through one or more fractional distillation columns to remove lighter hydrocarbons.

$C_5$ hydrocarbons can be separated from pygas while olefins are converted to alkanes. The separated $C_5$ stream can be returned to the cracking furnace as feedstock. This process can cause the conversion of certain $C_5$ hydrocarbons, e.g., isoprene and cyclopentadiene, to what can be less valuable chemicals such as isopentane and cyclopentane.

Therefore, there remains a need for improved techniques for integrating the processing of pygas with the utilization of $C_5$ hydrocarbons including isoprene and cyclopentadiene.

SUMMARY OF THE DISCLOSED SUBJECT MATTER

The disclosed subject matter provides processes and systems for recovering isoprene, pyperylene and cyclopentadiene from pygas.

In certain embodiments, processes for treating pygas can include depentanizing the pygas to produce a $C_5$ stream and a $C_6$+ stream and contacting the $C_6$+ stream with a first catalyst to form one or more hydrotreatment products. Example processes can further include separating the $C_5$ stream to form a product stream and a raffinate stream. The processes can also include contacting the raffinate stream with a second catalyst to produce alkanes. In certain instances, the pygas stream, the $C_5$ stream, and/or the $C_6$+ stream can be introduced into or contacted with a sulfur removal unit (e.g., a sulfur removal adsorption bed, amine treatment unit, etc.) to remove sulfur containing compounds (e.g., mercaptains, carbon sulfides, hydrogen sulfide, etc.) from these streams prior to coming into contact with the first and/or second catalysts. Removal of sulfur containing compounds from these streams can help protect the first and/or second catalysts from deactivation. In preferred instances, the sulfur removal unit can be positioned just before the $C_5$ stream and/or the $C_6$+ stream enter the hydrogenation reactor/unit or the hydrotreatment reactor/unit, respectively.

In certain embodiments, the first and/or second catalyst is a hydrogenation catalyst. For example the second catalyst can be a $C_5$ or $C_4/C_5$ hydrogenation catalyst.

In certain embodiments, the product stream can include isoprene, piperylene, and/or dicyclopentadiene.

In certain embodiments, the process can further include deoctanizing the hydrotreatment products to form a benzene, toluene, and/or xylene stream and a $C_9$+ hydrocarbon stream. The processes can further include cracking the alkanes to produce feedstock.

The presently disclosed subject matter also provides processes for treating pygas which can include depentanizing the pygas to produce a $C_5$ stream and a $C_6$+ stream. Example processes can further include contacting the $C_6$+ stream with a first catalyst to form hydrotreatment products and separating the $C_5$ stream to form a product stream and a raffinate stream. The process can additionally include separating the raffinate stream to form a $C_4$ raffinate stream and a $C_5$ raffinate stream and contacting the $C_5$ raffinate stream with a second catalyst to produce alkanes.

In certain embodiments, the second catalyst is a $C_5$ hydrogenation catalyst.

The presently disclosed subject matter also provides systems for processing pygas which can include a first distillation column configured to separate pygas to produce a $C_5$ stream and $C_6$+ stream and a hydrotreatment unit, coupled to the first distillation column, configured to hydrotreat the $C_6$+ stream to form one or more hydrotreatment products. Example systems can also include a second distillation column, coupled to the hydrotreatment unit, configured to produce a benzene, toluene, and/or xylene stream and a $C_9$+ hydrocarbon stream and a separations unit, coupled to the first distillation column, configured to produce a $C_5$ raffinate stream and a isoprene, piperylene, cyclopentadiene stream. The system can further include a hydrogenation reactor, coupled to the separations unit, which can include a catalyst to convert the $C_5$ raffinate stream into alkanes. In certain aspects, the system can also include at least one, two, three, or more sulfur removal units (e.g., a sulfur removal adsorption bed, amine treatment unit, etc.) to remove sulfur containing compounds (e.g., mercaptains, carbon sulfides, hydrogen sulfide, etc.) from the pygas stream, the $C_5$ stream and/or the $C_6$+ stream. For example, a sulfur removal unit can be coupled to and positioned between the separations unit and the hydrogenation reactor. Alternatively, or additionally, a sulfur removal unit can be coupled to and positioned between the first distillation column and the hydrotreatment unit. Even further, a sulfur removal unit can be coupled to the first distillation column such that the pygas is first treated to remove (e.g., reduce) sulfur containing compounds prior to entering the first distillation column.

In certain embodiments, the first distillation column is a depentanizer column. The second distillation column can be an deoctanizer column, and the hydrogenation reactor can be a three bed deep hydrogenation reactor.

DETAILED DESCRIPTION

The presently disclosed subject matter provides methods and systems for recovering $C_5$ hydrocarbons from pygas.

Figure 1:
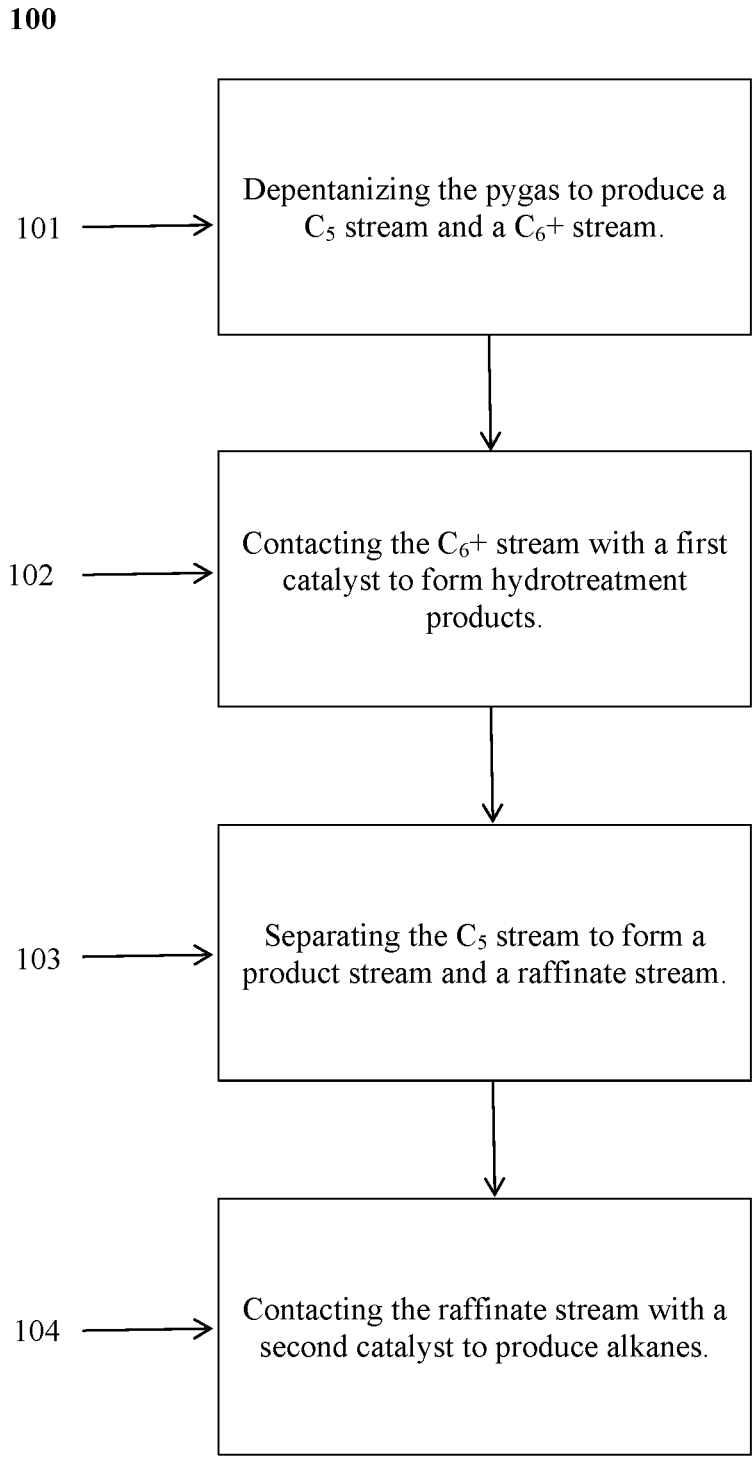
FIG. 1 depicts a method for recovering isoprene, piperylene, and dicyclopentadiene from pygas according to one exemplary embodiment of the disclosed subject matter.

The presently disclosed subject matter also provides methods for recovering isoprene and cyclopentadiene from pygas. For the purpose of illustration and not limitation, FIG. 1 is a schematic representation of an exemplary method according to a non-limiting embodiment of the disclosed subject matter.

In certain embodiments, a method 100 for recovering isoprene and cyclopentadiene from pygas includes depentanizing the pygas to produce a $C_5$ stream and a $C_6$+ stream. The pygas of the presently disclosed subject matter can originate from various sources, for example other chemical processes, e.g., ethylene production or the cracking of naphtha, butanes, or gas oil. The pygas can include alkanes, alkenes, alkynes, aromatics, naphthenes, alkyl aromatics, and polyaromatics. For example, the pygas can include cyclopentadiene and/or dicyclopentadiene.

As used herein, the term "about" or "approximately" means within an acceptable error range for the particular value as determined by one of ordinary skill in the art, which will depend in part on how the value is measured or determined, i.e., the limitations of the measurement system. For example, "about" can mean a range of up to 20%, up to 10%, up to 5%, and or up to 1% of a given value.

In certain embodiments, the method can include separating a $C_5$ stream from the pygas 101. In certain embodiments, the $C_5$ fraction can be recovered from the pygas by distillation, i.e., in a fractional distillation column. The distillation column can be a depentanizer column. The $C_5$ fraction can include aliphatic and aromatic hydrocarbons, e.g., pentanes, pentenes, pentynes, cyclopentanes, cyclopentenes, and/or cyclopentadiene. In certain embodiments, a stream containing $C_6$+ hydrocarbons is also recovered, e.g., by distillation.

In certain embodiments, the method can further include contacting the $C_6$+ hydrocarbon stream with a first catalyst to form hydrotreatment products 102. For example, the $C_6$+ stream can be contacted with a catalyst, e.g., in a hydrotreatment reactor. In certain embodiments, the catalyst is any hydrogenation catalyst known in the art. In certain embodiments, the catalyst can include nickel, platinum, and/or palladium supported on alumina or the like. In certain embodiments, the $C_6$+ hydrocarbon stream can be introduced into or contacted with a sulfur removal unit (e.g., a sulfur removal adsorption bed, amine treatment unit, etc.) to remove sulfur containing compounds (e.g., mercaptains, carbon sulfides, hydrogen sulfide, etc.) from the stream prior to coming into contact with the first catalyst. In certain embodiments, the method can further include recovering benzene, toluene, and/or xylene from the hydrotreatment products, e.g., in a distillation column. The distillation column can be a deoctanizer column. In certain embodiments, the method can further include recovering $C_9$+ hydrocarbons from the hydrotreatment products, e.g., in a distillation column. The distillation column can be the same deoctanizer column and can operate from between about 80° C. to about 200° C. of temperature and pressures from between about 1 bar to about 10 bars.

In certain embodiments, the method 100 can further include separating the $C_5$ stream to form a product stream and a raffinate stream 103. For example, a product stream can be recovered from the $C_5$ stream by separation, i.e., in a separations unit via a series of separations, including, but not limited to, extractive distillation. The product stream can include chemicals such as isoprene, piperylene and cyclopentadiene. In certain embodiments, the cyclopentadiene is dimerized to dicyclopentadiene (DCPD).

In certain embodiments, the raffinate stream includes the remaining $C_5$ and/or $C_4$ hydrocarbons. In certain embodiments, the $C_4$ hydrocarbons can be recovered from the raffinate stream, e.g., in a hydrotreatment reactor. The $C_4$ hydrocarbons can be recycled to a cracker furnace. Alternatively, in other embodiments, the $C_4$ hydrocarbons are not separated from the raffinate stream and the raffinate stream is contacted with a second catalyst to produce alkanes 104. In certain embodiments, the raffinate stream can be introduced into or contacted with a sulfur removal unit (e.g., a sulfur removal adsorption bed, amine treatment unit, etc.) to remove sulfur containing compounds (e.g., mercaptains, carbon sulfides, hydrogen sulfide, etc.) from the stream prior to coming into contact with the second catalyst. In certain embodiments the second catalyst is a $C_4/C_5$ hydrogenation catalyst. Hydrogenation catalysts can include, but are not limited to, nickel, palladium and platinum on an aluminum support or the like. In certain embodiments, the alkanes are further processed to obtain feedstock, e.g., in a cracker furnace.

Figure 2:
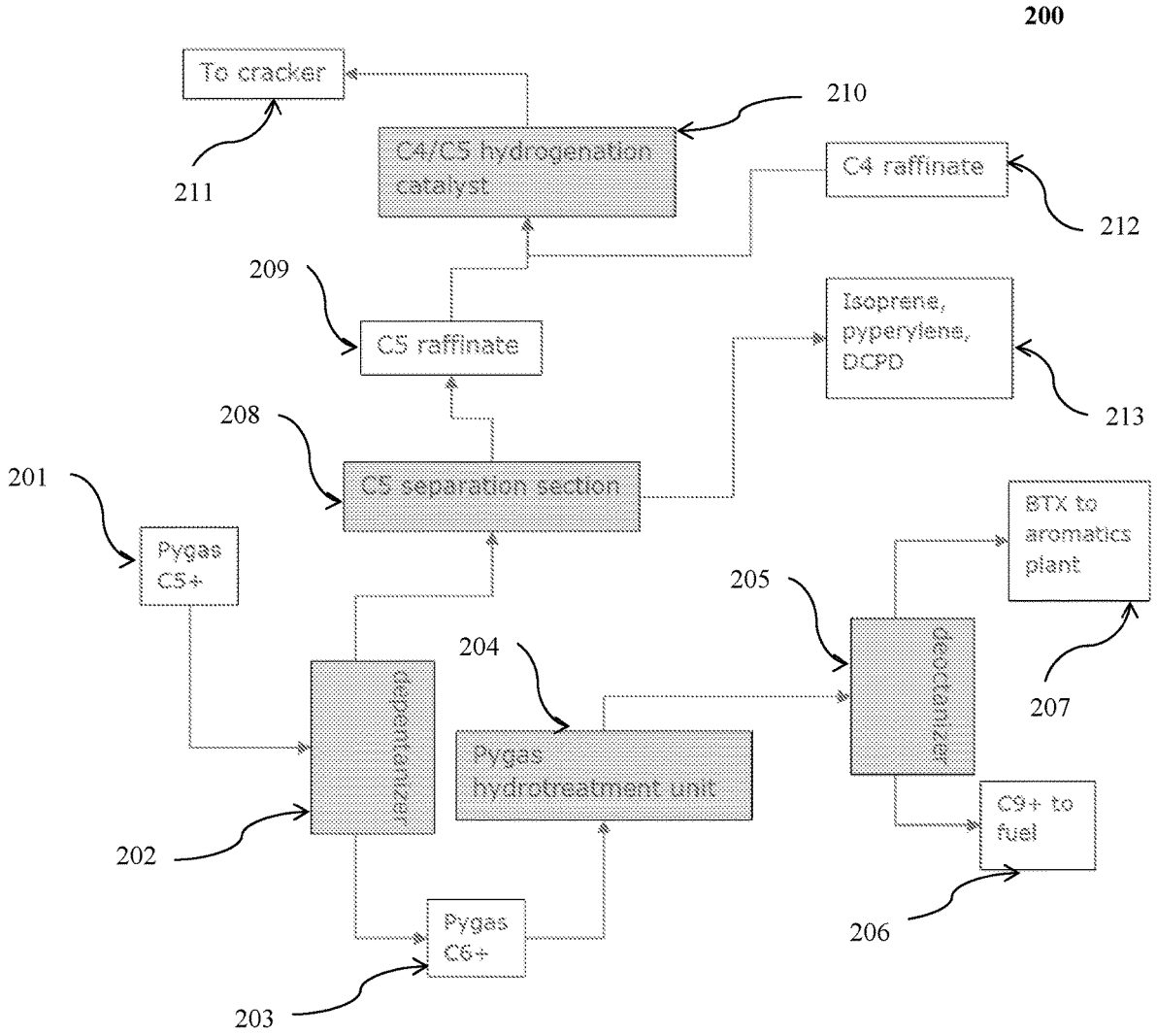
FIG. 2 depicts a system for recovering isoprene, piperylene, and dicyclopentadiene from pygas according to another exemplary embodiment of the disclosed subject matter.

The presently disclosed subject matter further provides systems for processing pygas. The system can include one or more distillation columns, e.g., depentanizer and/or deoctanizer columns, and one or more reactors which can include one or more catalysts. For the purpose of illustration and not limitation, FIG. 2 is a schematic representation of an exemplary system according to a non-limiting embodiment of the disclosed subject matter.

In certain embodiments, a system 200 for recovering dicyclopentadiene from pygas includes a pygas stream 201. To preserve the $C_5$ valuable chemicals, a depentanizer column 202 is placed before the hydrotreatment reactor 204, $C_5$ hydrocarbons are separated in the overhead stream from the $C_6$+ hydrocarbons of pygas in the depentanizer column. The depentanizer column can be a distillation column. Although not show in FIG. 2, in certain embodiments, a sulfur removal unit can be coupled to the depentanizer column 202 such that the pygas is first treated to remove (e.g., reduce) sulfur containing compounds prior to entering depentanizer column 202. Additionally, or alternatively, a sulfur removal unit can be coupled to the depentanizer column 202 and the hydrotreatment reactor 204 to remove (e.g., reduce) sulfur containing compounds from the $C_6$ stream 203 prior to entering the hydrotreatment reactor 204.

The bottom stream of the depentanizer column is removed as $C_6$+ hydrocarbons 203. In certain embodiments, the depentanizer column's overhead stream is coupled to a separations unit 208 for separating the $C_5$ stream to recover isoprene, piperylene and cyclopentadiene 213 from the stream. In certain embodiments, the cyclopentadiene 213 is dimerized to dicyclopentadiene (DCPD) as a final product. In certain embodiments, the separations unit 208 is also coupled to a hydrogenation reactor 210 for separating the remains of the $C_5$ stream (referred to as raffinate) 209 before $C_4$ is recycled back 212 to the cracker 211. In certain embodiments, the reactor 210 includes a catalyst. In other embodiments the catalyst can be a $C_4$ hydrogenation catalyst or a $C_4/C_5$ hydrogenation catalyst that is capable of hydrogenating mixed raffinate streams of $C_4$-$C_5$ hydrocarbons. In certain embodiments, the reactor 210 is a three bed deep hydrogenation reactor that converts all hydrocarbons to alkanes. Although not shown in FIG. 2, in certain embodiments, a sulfur removal unit can be coupled to and positioned between the separations unit 208 and the hydrogenation reactor 210 to remove (e.g., reduce) sulfur containing compounds from the $C_5$ stream prior to entering the hydrogenation reactor 210. In certain embodiments, the outlet stream of this reactor 210 can be coupled to the cracker furnaces 211 without the need for another depentanizer column.

"Coupled" as used herein refers to the connection of a system component to another system component by any means known in the art. The type of coupling used to connect two or more system components can depend on the scale and operability of the system. For example, and not by way of limitation, coupling of two or more components of a system can include one or more joints, valves, fitting, coupling, transfer lines or sealing elements. Non-limiting examples of joints include threaded joints, soldered joints, welded joints, compression joints and mechanical joints. Non-limiting examples of fittings include coupling fittings, reducing coupling fittings, union fittings, tee fittings, cross fittings and flange fittings. Non-limiting examples of valves include gate valves, globe valves, ball valves, butterfly valves, needle valves and check valves.

In certain embodiments, a system 200 includes processing of the $C_6$+ hydrocarbons of pygas, extracted from depentanizer column bottom 203. In certain embodiments, the depentanizer column bottom is coupled to a pygas hydrotreatment unit 204 which includes a catalyst. In further embodiments, the pygas hydrotreatment unit 204 can be coupled to a deoctanizer for separating a $C_9$+ hydrocarbon stream 206 and a benzene, toluene, and/or xylene stream 207. The deoctanizer column can be a distillation column.

The distillation columns, e.g., a depentanizer or deoctanizer, for use in the presently disclosed subject matter can be any type known in the art to be suitable for fractional distillation. The one or more distillation columns can be adapted to continuous or batch distillation. The one or more distillation columns can be coupled to one or more condensers and one or more reboilers. The one or more distillation columns can be stage or packed columns, and can include plates, trays and/or packing material. The one or more distillation columns can be coupled to one or more transfer lines. The one or more distillation columns can be made of any suitable material including, but not limited to, aluminum, stainless steel, carbon steel, glass-lined materials, polymer-based materials, nickel-base metal alloys, cobalt-based metal alloys or combinations thereof. The presently disclosed systems can further include additional components and accessories including, but not limited to, one or more gas exhaust lines, cyclones, product discharge lines, reaction zones, heating elements and one or more measurement accessories. The one or more measurement accessories can be any suitable measurement accessory known to one of ordinary skill in the art including, but not limited to, pH meters, flow monitors, pressure indicators, pressure transmitters, thermos-wells, temperature-indicating controllers, gas detectors, analyzers and viscometers. The components and accessories can be placed at various locations within the system.

The methods and systems of the presently disclosed subject matter provide advantages over certain existing technologies. Exemplary advantages include a decrease in capital and separation energy costs due to the saving of an additional depentanizer column. Also, due to the separation of valuable chemicals from the $C_5$ stream, there is less hydrogen required for the hydrogenation reactor. In addition, when the $C_4/C_5$ hydrogenation catalyst is a three bed hydrogenation reactor which can perform deep hydrogenation, the $C_4/C_5$ hydrocarbons recycled to the cracker are totally hydrogenated and therefore have a low tendency to form coke in the cracker. The diversion of a $C_5$ hydrocarbon stream from the hydrotreater reactor also offloads the pygas reactor capacity by about 25-40% allowing an aromatics plant to process more aromatics using the same reactor unit. Another benefit of the presently disclosed subject matter is that the same depentanizer column used after pygas hydrotreatment unit can be used upstream without modification. Yet another benefit of the presently disclosed subject matter is that the $C_4/C_5$ hydrogenation reactor can be a 3 stage reactor which can perform deep hydrogenation of $C_5$ unsaturated hydrocarbons. This is unlike pygas hydrogenation which usually utilizes one or two stage reactors to avoid hydrogenating aromatic products. The deep hydrogenation of $C_5$ and $C_4$ hydrocarbons ensures that only alkanes are recycled to cracker. This reduces coke formation in cracker tubes and gives longer cycle time.

In addition to the various embodiments depicted and claimed, the disclosed subject matter is also directed to other embodiments having other combinations of the features disclosed and claimed herein. As such, the particular features presented herein can be combined with each other in other manners within the scope of the disclosed subject matter such that the disclosed subject matter includes any suitable combination of the features disclosed herein. The foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A process for treating pygas, the process comprising the steps of:

a) depentanizing the pygas to produce a $C_5$ stream and a $C_6$+ stream;

b) contacting the $C_6$+ stream with a first catalyst to form one or more hydrotreatment products;

c) separating the $C_5$ stream to form a product stream and a raffinate stream, wherein the raffinate stream includes remaining $C_5$ and $C_4$ hydrocarbons;

d) separating the raffinate stream to produce a $C_4$ raffinate stream and a $C_5$ raffinate stream; and e) contacting the $C_5$ raffinate stream with a second catalyst to produce alkanes;

wherein the first and/or second catalyst comprises a hydrogenation catalyst; and wherein the second catalyst comprises a $C_5$ or $C_4/C_5$ hydrogenation catalyst.

2. The process of claim 1, wherein the second catalyst comprises a $C_5$ hydrogenation catalyst.

3. The process of claim 1, wherein the product stream comprises isoprene, piperylene, and dicyclopentadiene.

4. The process of claim 1, wherein the contacting the $C_6$+ stream further comprises deoctanizing the hydrotreatment products to form a benzene, toluene, and/or xylene stream and a $C_9$+ hydrocarbon stream.

5. The process of claim 1, wherein the contacting the raffinate stream further comprises cracking the alkanes to produce feedstock.

6. The process of claim 1, further comprising contacting the raffinate stream with a sulfur removal unit to remove sulfur containing compounds from the raffinate stream prior to contacting step d).

7. The process of claim 1, further comprising contacting the $C_6$+ stream with a sulfur removal unit to remove sulfur containing compounds from the $C_6$+ stream prior to contacting step b).

* * * * *